US006729504B2

(12) United States Patent
Bougamont et al.

(10) Patent No.: US 6,729,504 B2
(45) Date of Patent: May 4, 2004

(54) STATIC DEVICE FOR AIR REPLENISHING A LIQUID PRODUCT DISPENSER

(75) Inventors: Jean-Louis Bougamont, Eu (FR); Pierre Dumont, Eu (FR)

(73) Assignee: Rexam Dispensing Systems, Le Treport (FR)

( * ) Notice: Subject to any disclaimer, the term of this patent is extended or adjusted under 35 U.S.C. 154(b) by 0 days.

(21) Appl. No.: 10/297,613

(22) PCT Filed: Jun. 14, 2001

(86) PCT No.: PCT/FR01/01846

§ 371 (c)(1),
(2), (4) Date: Dec. 16, 2002

(87) PCT Pub. No.: WO01/96030

PCT Pub. Date: Dec. 20, 2001

(65) Prior Publication Data

US 2003/0150882 A1 Aug. 14, 2003

(30) Foreign Application Priority Data

Jun. 16, 2000 (FR) ..... 00 07682

(51) Int. Cl.[7] ..... B67D 5/42
(52) U.S. Cl. ..... 222/189.09; 222/321.9
(58) Field of Search ..... 222/189.09, 321.1, 222/321.3, 321.7, 321.9, 375

(56) References Cited

U.S. PATENT DOCUMENTS

| | | | | | |
|---|---|---|---|---|---|
| 1,264,554 | A | * | 4/1918 | Peron | 222/385 |
| 2,861,839 | A | * | 11/1958 | Mellon | 222/321.9 |
| 3,596,808 | A | * | 8/1971 | Corsette | 222/321.9 |
| 5,727,715 | A | * | 3/1998 | McKenna et al. | 222/321.9 |
| 5,927,559 | A | * | 7/1999 | Bommer et al. | 222/189.09 |
| 5,950,879 | A | * | 9/1999 | Ritsche | 222/321.9 |
| 6,186,370 | B1 | * | 2/2001 | de Pous et al. | 222/321.9 |
| 6,244,472 | B1 | * | 6/2001 | Hennemann | 222/189.09 |
| 6,279,786 | B1 | * | 8/2001 | de Pous et al. | 222/321.9 |
| 6,360,919 | B1 | * | 3/2002 | Brule | 222/189.09 |
| 2002/0066753 | A1 | * | 6/2002 | Greiner-Perth et al. | 222/321.9 |
| 2003/0150881 | A1 | * | 8/2003 | Bougamont et al. | 222/321.9 |

* cited by examiner

*Primary Examiner*—Kenneth Bomberg
(74) *Attorney, Agent, or Firm*—Bacon & Thomas, PLLC

(57) ABSTRACT

The invention relates to an air-intake device for drawing air into a liquid dispenser equipped with a rigid reservoir (R) and with an atmospheric pump (P) provided, in particular, with a cylindrical and conical body (C) underlying a support flange (S) fixed to the reservoir (R), said device being characterized in that it comprises a sleeve (1) designed to be fitted around said body (C) of the pump, under said flange (S), and having its bottom portion provided with a vent-forming collar (10) whose inside wall which serves to come into radial clamping engagement against said body has a surface state such that said collar (10) is both impermeable to the liquid and also permeable to air.

10 Claims, 5 Drawing Sheets

STATIC DEVICE FOR AIR REPLENISHING A LIQUID PRODUCT DISPENSER

The present invention relates to an air-intake device for drawing air into a liquid dispenser.

A liquid dispenser is generally equipped with a rigid reservoir and with an atmospheric pump provided, in particular, with a cylindrical and conical body and with a support flange co-operating, as applicable, with an assembly ring or with an assembly cap crimped to the neck of the reservoir.

A metered quantity or "dose" of liquid being dispensed generates suction in the fixed-capacity reservoir, and it is necessary to compensate for said suction by drawing in a corresponding volume of air. To this end, the pump body is provided with vent orifices suitable for putting the internal volume of the reservoir into communication with the outside during the final stage of dispensing.

Another technique for re-establishing the pressure balance necessary for the dispenser to operate properly consists in providing clearance between the fixing flange and/or the pump body and the neck of the reservoir and/or the assembly cap so as to enable air to be sucked in.

However, in all known techniques, the vent-forming means also enable liquid to leak out, especially when the level of liquid is above the vent, either by construction or by the dispenser being used specifically in the upside down position.

An object of the present invention is to solve those technical problems satisfactorily without modifying the conventional structure of dispensers.

The invention achieves this object by means of an air-intake device characterized in that it comprises a sleeve designed to be fitted around said body of the pump, under said flange, and having its bottom portion provided with a vent-forming collar whose inside wall which serves to come into radial clamping engagement against said body has a surface state such that said collar is both impermeable to the liquid and also permeable to air.

In a specific embodiment, the surface of the inside wall of said collar has grains resulting from electrical discharge machining.

According to an advantageous characteristic, above said collar, said sleeve co-operates with the wall of said body to define an empty space suitable for communicating with the outside by forming at least one suction duct for drawing air in.

In a variant, said empty space is defined by at least one groove extending over the outside side wall of the body of the pump. This variant applies more particularly to pumps equipped with a vent orifice by construction.

Preferably, in the free state, the inside diameter of said sleeve is less than or equal to the outside diameter of the body in the vent zone. In addition, the top edge of said sleeve then comes into abutment against said flange.

In another variant, said empty space is formed by the gap situated between the inside wall of the sleeve and the outside side wall of the body of the pump, above the collar. This variant applies particularly to pumps not provided with a vent orifice.

Preferably, the top portion of said sleeve is then provided with crenellations making it possible for air to be drawn in laterally.

Advantageously, the collar is frustoconical in profile, while the sleeve is cylindrical and has a top edge that is beveled. The device of the invention makes it possible to draw in sufficient air while also guaranteeing that the dispenser is airtight.

The static liquid-tightness of the collar may be adjusted as a function of the viscosity of the liquid to be packaged. The sleeve of the invention may be put in place after the pump has been manufactured without it being necessary to modify said pump.

In addition, the sleeve is applicable to precompression pumps with or without vent orifices.

The invention will be better understood on reading the following description with reference to the accompanying drawings, in which.

Figure 1A:
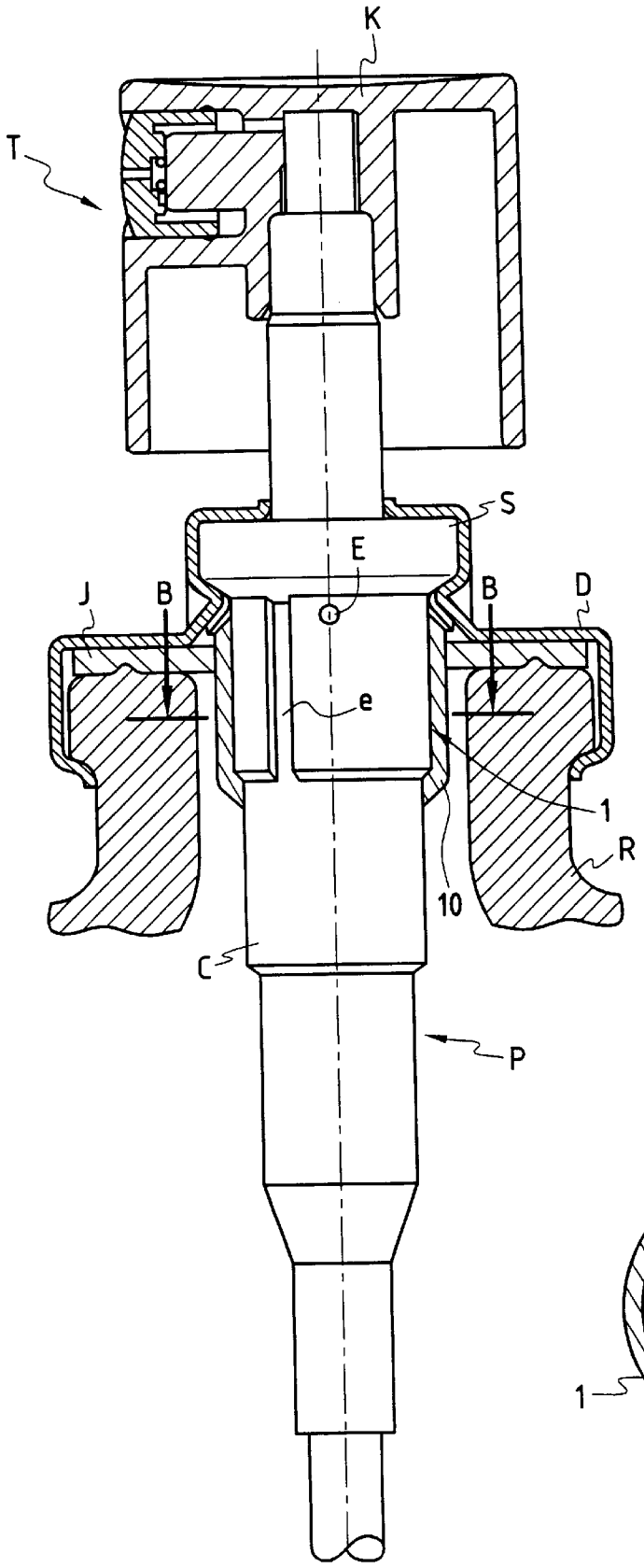
FIG. 1A is a view in section of a first embodiment of the invention during the rest stage.
Figure 1B:
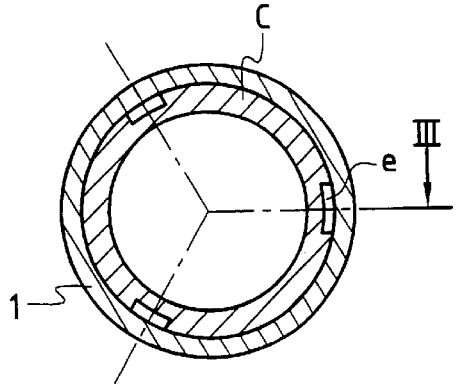
FIG. 1B is a view partially from above and partially in section on BB of the embodiment of FIG. 1A.
Figure 1C:
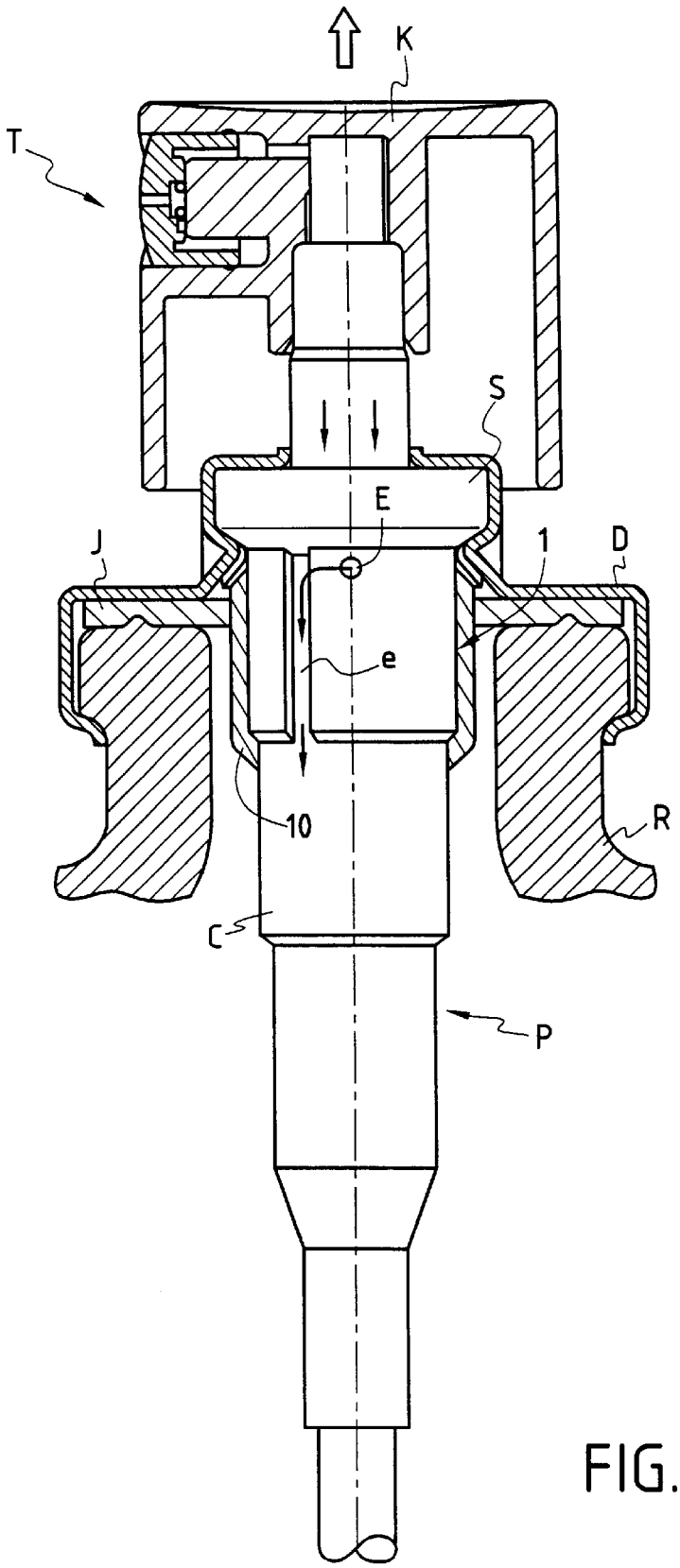
FIG. 1C is a view in section of the embodiment of FIG. 1A during the air-intake stage.

The device shown in FIGS. 1A and 1C is designed to be used in a liquid dispenser equipped with a rigid reservoir R (shown in part), and with an atmospheric pump provided, in particular, with a cylindrical and conical body C, underlying a support flange S suitable for being fixed to the neck of the reservoir R.

The dispenser shown further includes a pusher knob K carried by a spray head T mounted on the spray tube of the pump P, and a metal assembly ring D crimped both onto the flange S of the pump and onto the neck of the reservoir R, thereby holding a gasket J captive.

The device of the invention is designed to enable air to be drawn into the reservoir R after each occasion on which a metered quantity or "dose" of liquid is dispensed by the pump.

Figure 3:
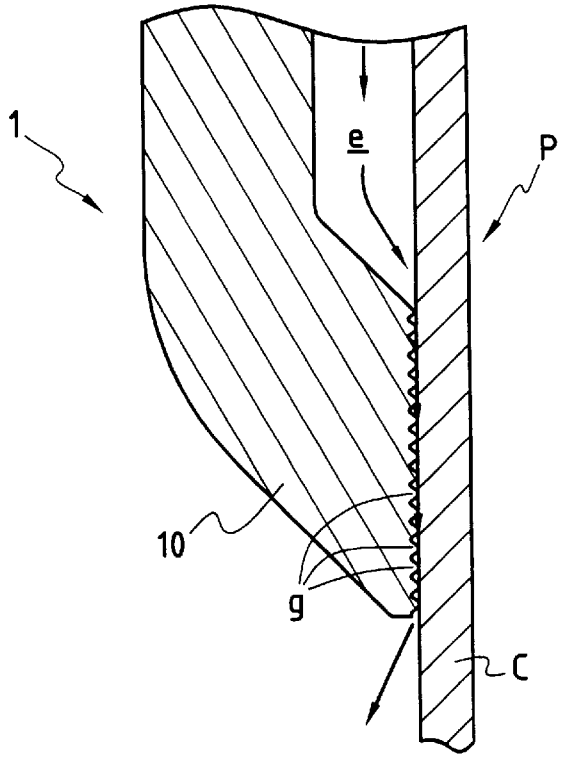
FIG. 3 shows a detail view in section of the embodiment of the sleeve of the invention corresponding to FIG. 1B, in a plane containing the middle axis of a groove in the pump body.

The device comprises a sleeve 1 made of an elastomer or plastomer material and designed to be fitted around the body C of the pump P, under the flange S. The bottom portion of the sleeve 1 is provided with a vent-forming collar 10 which is preferably frustoconical in profile, and whose inside wall comes into semi-leaktight radial clamping engagement against the outside side wall of the body C, as shown in detail in FIG. 3.

The surface state of the inside wall of the collar 10 is such that the semi-leaktight contact between said collar and the body C provides simultaneously both impermeability to the liquid contained in the reservoir R regardless of its angular position, and also permeability to air, at least from the outside of the reservoir to the inside of the reservoir R.

The appropriate surface state is uneven so as to define a fine network of small-size channels allowing air to pass through while preventing any leakage of the liquid.

The network is formed, for example, by subjecting the inside wall of the collar 10 to local electrical discharge machining (EDM).

This technique makes it possible to generate roughness q (see FIG. 3) or "grains" of size defined in a standardized scale referred to as the "Charmille" grain scale.

Depending on the type and physico-chemical properties of the liquid to be dispensed, the EDM is set so as to generate a determined grain size q and thus determined channel cross-sectional area.

Above the collar 10, the sleeve 1 co-operates with the wall of the body C of the pump P to define an empty space suitable for communicating with the outside atmosphere by forming at least one suction duct for drawing air in.

In the embodiment shown in FIGS. 1A and 1C, the pump P is provided with a vent orifice E passing through the wall of the body C and communicating with the outside, above the top edge of the sleeve 1 which is beveled in this example.

All the way along its length, the sleeve 1, in its free state, has an inside diameter equal to or slightly smaller than the outside diameter of the body C in the vent zone.

In this example, the empty space is defined by at least one groove, and preferably three grooves e, extending over the outside side wall of the body parallel to its generator lines, as shown in FIG. 1B.

Figure 2A:
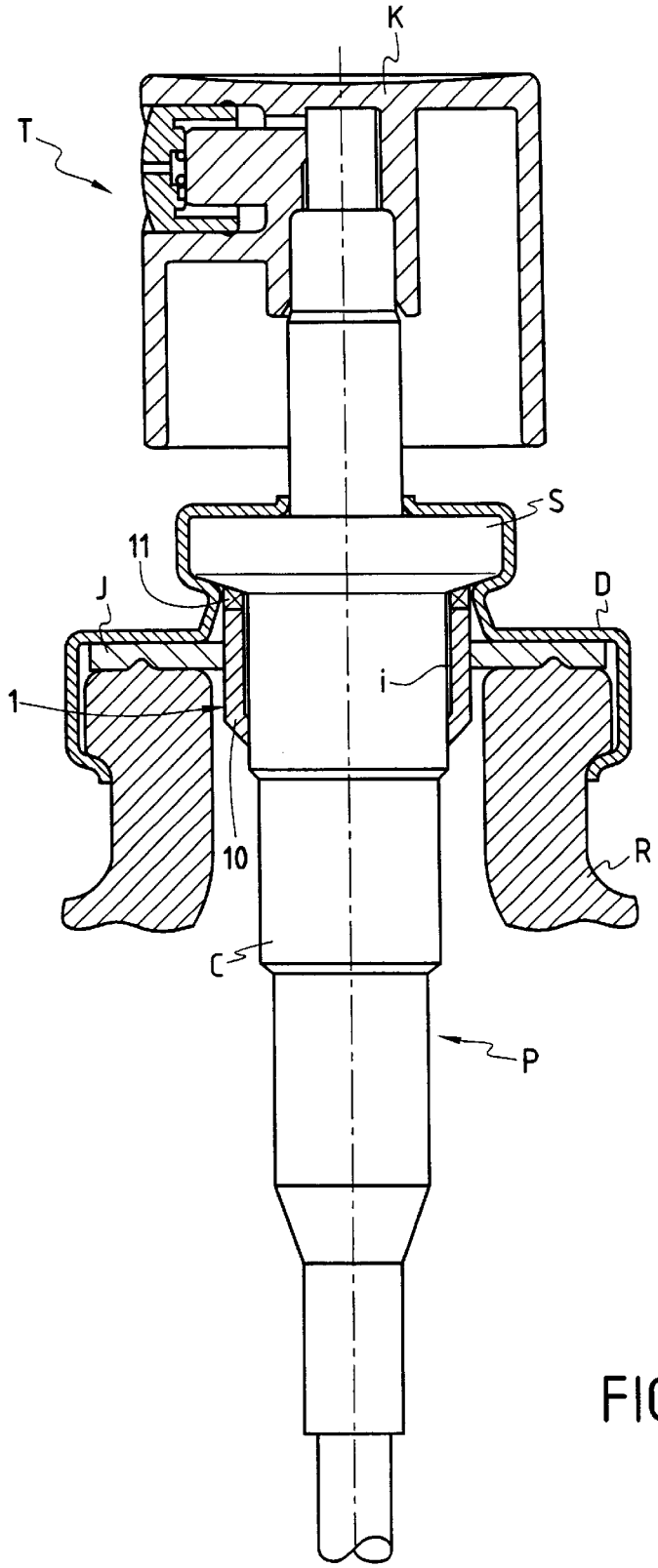
FIG. 2A is a view in section of a second embodiment of the device of the invention during the rest stage.
Figure 2B:
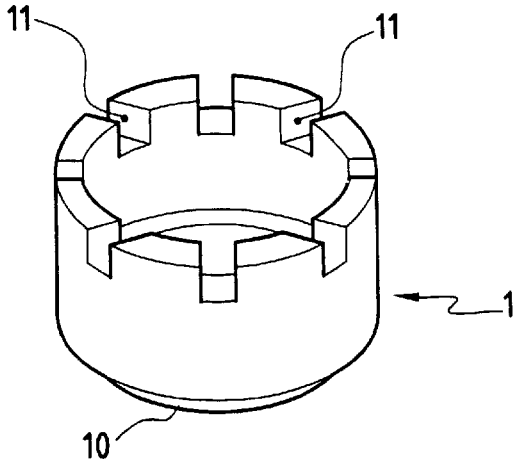
FIG. 2B is a view in perspective of the sleeve of the embodiment shown in FIG. 2A.
Figure 2C:
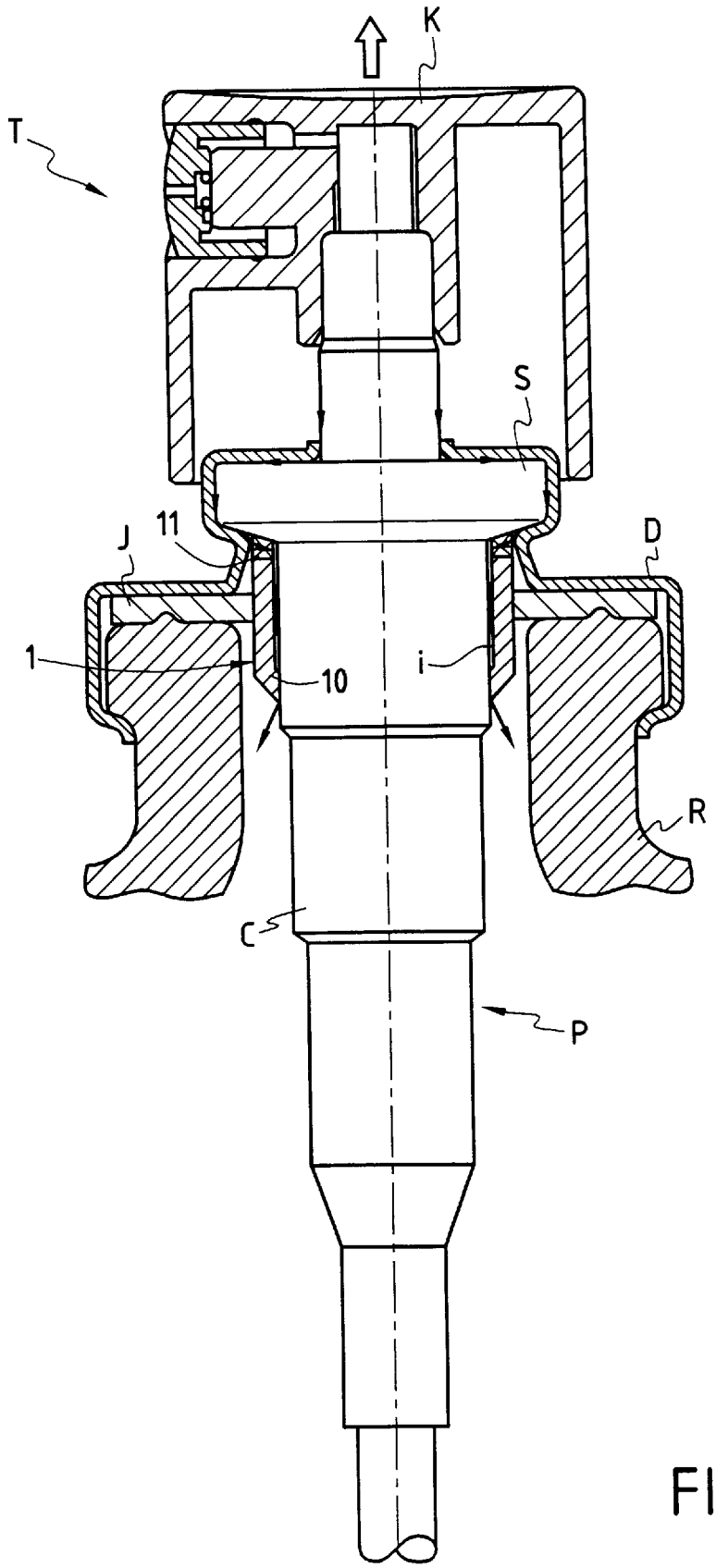
FIG. 2C is a view in section of the FIG. 2A embodiment, during the air-intake stage.

In the embodiment shown in FIGS. 2A and 2C, the body C of the pump P has no specific vent orifice.

At its bottom portion, the sleeve 1 has a collar 10 identical to the collar in the embodiment shown in FIGS. 1A and 1C, which collar is in semi-leaktight radial clamping engagement about the body C of the pump P. However, in this example, the sleeve 1 is formed with an inside diameter larger than the outside diameter of the body C. Thus, in this example, the empty space is formed of the cylindrical gap i situated between the inside wall of the sleeve 1 and the outside side wall C of the pump P, above the collar 10. At its top portion, the sleeve 1 is also provided with crenellations 11 enabling air to be drawn in laterally, and coming into abutment upwards against the flange S.

What is claimed is:

1. An air-intake device for drawing air into a liquid dispenser equipped with a rigid reservoir (R) and with an atmospheric pump (P) having a cylindrical and conical body (C) underlying a support flange (S) fixed to the reservoir (R), said device comprising a sleeve (1) configured to be fitted around said body (C) of the pump, under said flange (S), and having a bottom portion provided with a vent-forming collar (10) having an inside wall which is arranged to radially clamp against said body and includes a surface state such that said collar (10) is both impermeable to the liquid and also permeable to air.

2. The device according to claim 1, wherein the surface of the inside wall of said collar (10) has grains (g) resulting from electrical discharge machining.

3. The device according to claim 1, wherein above said collar (10), said sleeve (1) co-operates with a wall of said body (C) to define an empty space suitable for communicating with the outside by forming at least one suction duct for drawing air in.

4. The device according to claim 3, wherein said empty space is defined by at least one groove (e) extending over an outside side wall of the body (C) of the pump (P).

5. The device according to claim 4, wherein said body (c) has an inside and outside diameter, and, in the free state, the inside diameter of said sleeve (1) is less than or equal to the outside diameter of the body (C) in the vent zone.

6. The device according to claim 4, wherein a top edge of said sleeve (1) abuts against said flange (S).

7. The device according to claim 3, wherein said empty space is formed by a (i) defined between an inside wall of the sleeve (1) and an outside side wall of the body (C) of the pump (P), above the collar (10).

8. The device according to claim 7, wherein a top portion of said sleeve (1) is provided with crenellations (11) making it possible for air to be drawn in laterally.

9. The device according to claim 1, wherein said collar (10) is frustoconical in profile.

10. The device according to claim 1, wherein a top edge of said sleeve (1) is beveled.

* * * * *